US007055268B2

(12) United States Patent
Ha

(10) Patent No.: US 7,055,268 B2
(45) Date of Patent: Jun. 6, 2006

(54) LENGTH-ADJUSTABLE SHOE

(75) Inventor: Ki-Ho Ha, Pusan (KR)

(73) Assignee: Shin Kyung Chemical Co., Ltd. (KR)

( * ) Notice: Subject to any disclaimer, the term of this patent is extended or adjusted under 35 U.S.C. 154(b) by 0 days.

(21) Appl. No.: 10/976,604

(22) Filed: Oct. 29, 2004

(65) Prior Publication Data

US 2005/0055849 A1 Mar. 17, 2005

Related U.S. Application Data

(62) Division of application No. 10/315,695, filed on Dec. 10, 2002, now abandoned.

(51) Int. Cl.
*A43B 3/26* (2006.01)
*A43B 11/00* (2006.01)
*A43D 1/00* (2006.01)

(52) U.S. Cl. ..... 36/97; 36/8.4; 36/51

(58) Field of Classification Search ..... 36/97, 36/93, 100, 8.4, 51
See application file for complete search history.

(56) References Cited

U.S. PATENT DOCUMENTS

| | | | | |
|---|---|---|---|---|
| 797,966 | A | 8/1905 | Lange et al. | |
| 2,112,052 | A * | 3/1938 | Smith | 36/97 |
| 2,523,449 | A | 9/1950 | Rosenzweig | |
| 2,734,284 | A * | 2/1956 | Seurbom | 36/97 |
| 4,120,103 | A | 10/1978 | Colby | |
| 4,944,099 | A | 7/1990 | Davis | |
| 5,659,980 | A | 8/1997 | Lin | |
| 5,765,296 | A | 6/1998 | Ludemann et al. | |
| 5,794,362 | A | 8/1998 | Polk, III et al. | |
| 5,950,333 | A | 9/1999 | Tsen | |
| 6,045,144 | A | 4/2000 | Wong | |
| 6,138,385 | A | 10/2000 | Jungkind et al. | |
| 6,189,239 | B1 | 2/2001 | Gasparovic et al. | |
| 6,438,872 | B1 | 8/2002 | Chil | |
| 6,450,510 | B1 * | 9/2002 | Liu | 36/97 |
| 2002/0170206 | A1 | 11/2002 | Chil et al. | |
| 2002/0178617 | A1 | 12/2002 | Chil et al. | |

FOREIGN PATENT DOCUMENTS

WO WO 92/18023 A1 * 10/1992

* cited by examiner

*Primary Examiner*—Anthony Stashick
(74) *Attorney, Agent, or Firm*—Michael Best & Friedrich LLP

(57) ABSTRACT

A length-adjustable shoe is disclosed. The shoe includes an outsole, an insole attached on the outsole, an upper attached on the insole, means for adjusting a length of the insole, which is provided at the insole, an upper tension member provided at the upper, a lower tension member provided at the outsole, and means for fastening a front part and a rear part of the upper divided by the upper tension member to maintain a size of the shoe at a wearer's foot size. The shoe is extended and contracted longitudinally without change of an outer shape of the shoe, by the length-adjusting means, the upper tension member, the lower tension member, and the fastening means. The shoe can accommodate a wearer suffering hallux valgus or hallux varus, a wearer with both feet having different sizes, and a wearer with rapid growth rate. The shoe can be worn by a wearer for a long period of time without needless expenditure due to purchase of two pair of shoes.

2 Claims, 13 Drawing Sheets

LENGTH-ADJUSTABLE SHOE

CROSS-REFERENCE TO RELATED APPLICATIONS

This application is a division of U.S. patent application Ser. No. 10/315,695, filed Dec. 10, 2002 now abandoned.

BACKGROUND OF THE INVENTION

1. Field of the Invention

The present invention relates to a shoe, and more particularly to a length-adjustable shoe, which can be adjusted in its length within a predetermined range to accommodate children's feet growing through various sizes, and particularly to accommodate a user with both feet having different sizes, thereby relieving an economic burden due to frequent purchasing of shoes.

2. Description of the Prior Art

In general, a person puts shoes on both his or her feet before walking, so as to protect his or her naked feet from injury and to reduce impact directly transmitted to his or her feet's soles.

Every user purchases shoes after selecting shoes in consideration of size, design and function of shoes. Usually, children and youngsters purchase shoes somewhat larger than actual sizes of their feet because of rapid growth of their feet. In case of shoes worn by the children and youngsters, the shoes must be discarded after use for a short period of time, for example one year or two years, because the shoes cannot accommodate the child's feet any more. That is, the shoes become useless due to growth of the child's feet before the soles of the shoes are completely worn. Amounts of discarded shoes gradually increase due to growth of population, and an enormous number of shoes cannot be reused, thereby wasting a considerable resources.

In case of a user with both feet having different sizes, most users must buy two pairs of shoes so as to put the left shoe of one pair of shoes on his left foot and to put the right shoe of the other pair of shoes on his right foot, or the user must buy shoes made to measure. Therefore, since such users must pay for the additional pair of shoes and must dispose the two unsuitable shoes, the users are imposed with burden of paying double expenses.

SUMMARY OF THE INVENTION

Accordingly, the present invention has been made keeping in mind the above problems occurring in the prior art, and an object of the present invention is to provide a length-adjustable shoe, which can be adjusted in its length within a predetermined range to be suitable to a wearer's feet and particularly to be suitable to a wearer with both feet having different sizes, thereby relieving economic burden due to double expenses for buying shoes.

In order to accomplish the above object, the present invention provides a length-adjustable shoe, comprising: an outsole; an insole attached on the outsole; an upper attached on the insole and covering a wearer's instep; means for adjusting a length of the insole to be suitable to a wearer's foot, which is provided at the insole; an upper tension member provided at the upper to provide tightening force to the upper; a lower tension member provided at the outsole to provide tightening force to the outsole; and means for fastening a front part and a rear part of the upper divided by the upper tension member, which is provided at the front and rear parts of the upper to maintain a size of the shoe at a wearer's foot size.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Figure 1:
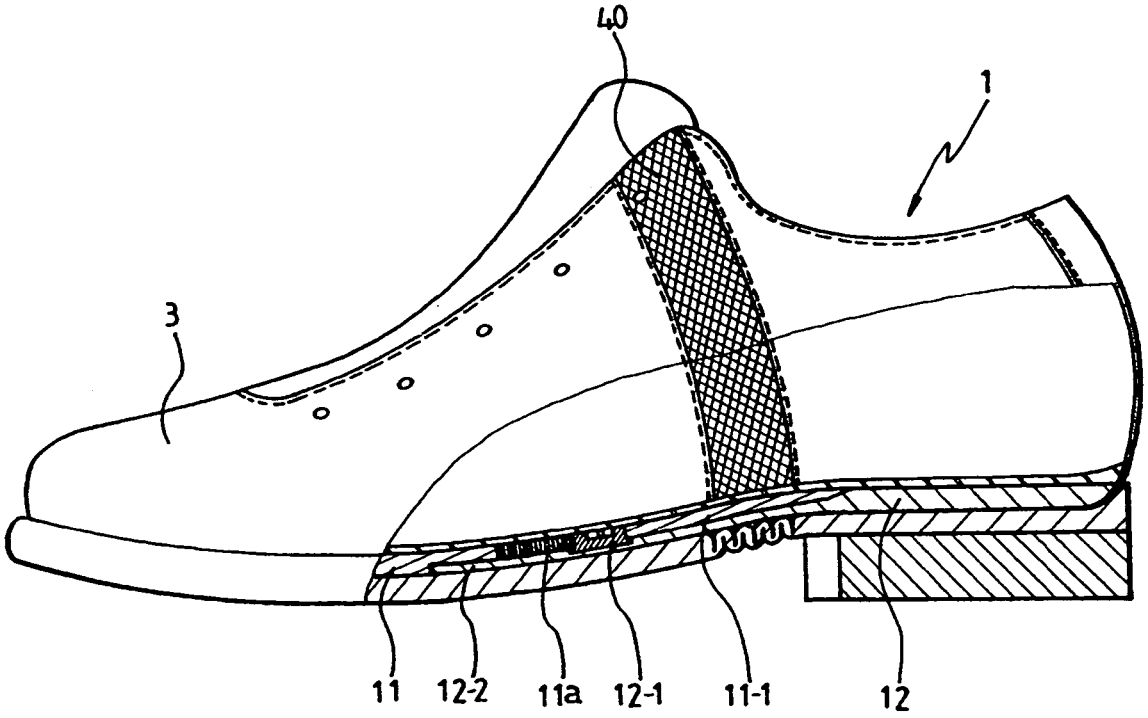
FIG. 1 is a side view of a shoe according to the present invention, which is partially broken away.

This invention will be described in further detail by way of example with reference to the accompanying drawings.

A shoe 1 according to the present invention includes an insole 2, which is divided into a front part and a rear part. The shoe 1 includes means 10, 20 or 30 for adjusting a length of the insole 2 to be suitable to a wearer's foot, which is provided at a predetermined position of the insole 2, an upper tension member 40 provided at an upper 3 of the shoe 1 to provide tightening force to the upper 3, a lower tension member 50 provided at an outsole 4 of the shoe 1 to provide tightening force to the outsole 4, and means 60 for fastening a front part of the upper 3 to a rear part of the upper 3, which is provided at the front and rear parts of the upper 3 to maintain a size of the shoe 1 at a wearer's foot size.

As shown in FIGS. 1 to 5, the means 10 for adjusting a length of the insole 2 includes a first insole joint part 11 corresponding to the front part of the insole 2, and a second insole joint part 12 corresponding to the rear part of the insole 2.

The first insole joint part 11 includes a dovetail groove 11-1 formed at a lower surface of the front part of the insole 2 and having a certain length, a rectangular length-adjusting hole 11-2 formed at the front part of the insole 2 to be positioned in the dovetail groove 11-1, and having a longitudinal rack 11*a* at its one side, and a fixing key 11-3 hingedly connected to one side of the length-adjusting hole 11-2 and having a fixing rack 11*b* at its one side.

The second insole joint part 12 includes a spur gear 12-1 having a proper diameter, which is engaged with the fixing rack 11*a* of the length-adjusting hole 11-2 and the fixing rack 11*b* of the fixing key 11-3 and is provided at its upper surface with a cross recess 12*b*, and a dovetail insert 12-2 having a proper length to be slidably inserted into the dovetail groove 11-1 and having a gear recess 12*a* at its upper surface to receive a lower portion of the spur gear 12-1.

As mentioned above, the fixing key 11-3 is connected to one side of the length-adjusting hole 11-2 of the first insole joint part 11. More specifically, one end of the fixing key 11-3 is hingedly connected to a front side of the length-adjusting hole 11-2, and the other end of the fixing key 11-3 is provided with a recess (not shown) to allow the fixing key 11-3 to be easily taken out of the length-adjusting hole, or is sized to be shorter than the length of the length-adjusting hole 11-2.

Facing ends of the first and second insole joint parts 11 and 12 are provided with inclined surfaces 11*c* and 12*c* corresponding to each other.

Figure 12:
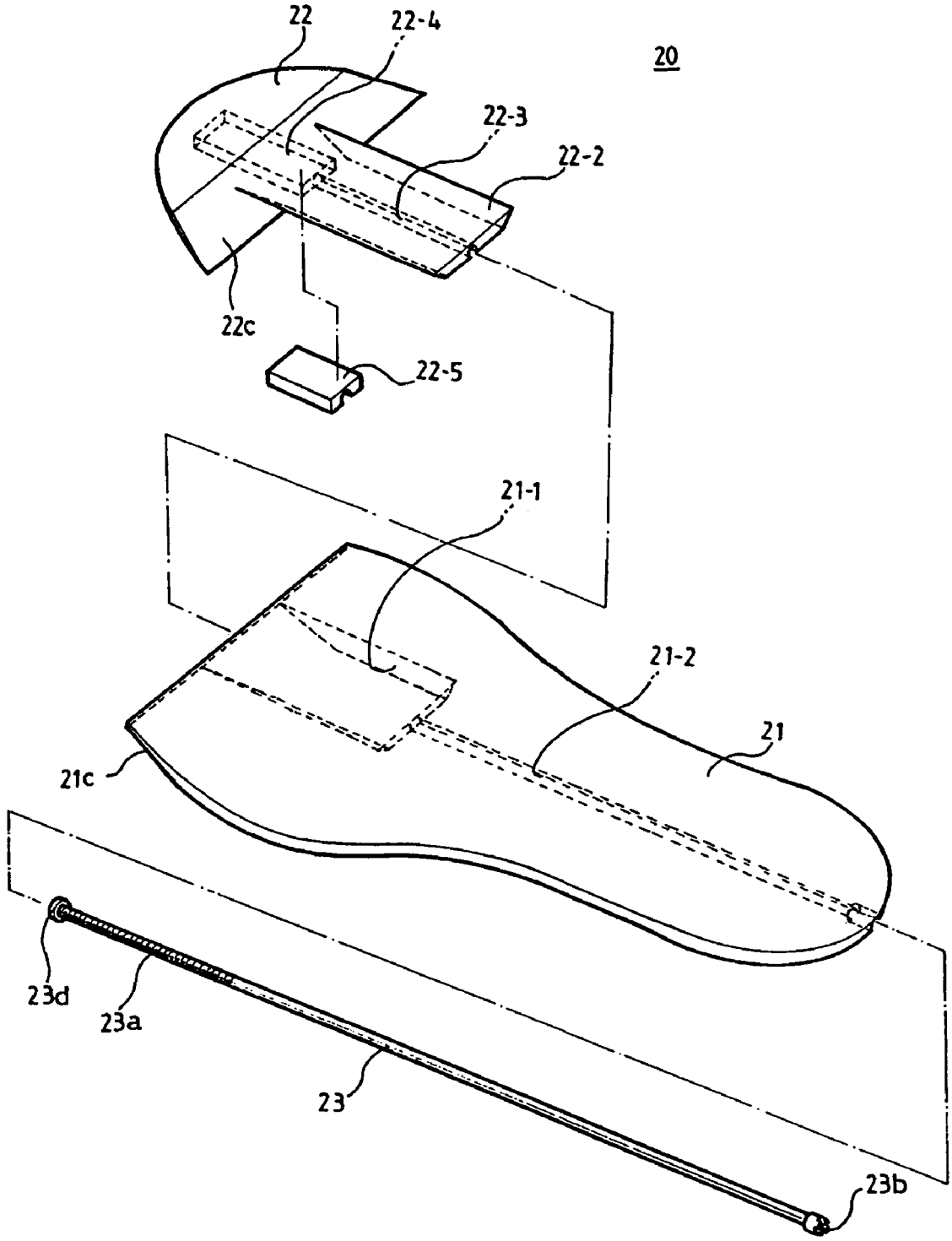
FIG. 12 is an exploded perspective view of another embodiment of an insole of the shoe according to the present invention.
Figure 13:
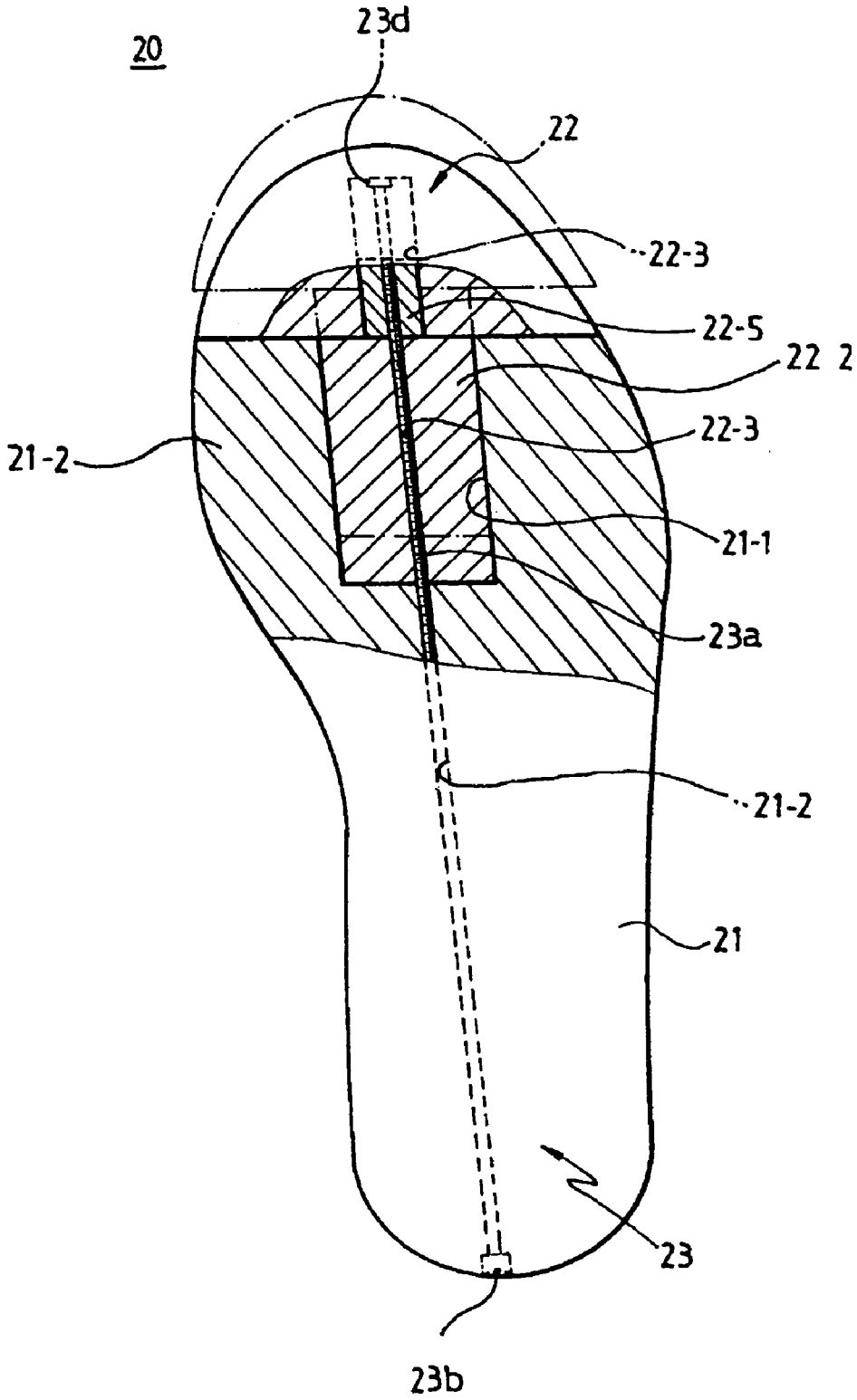
FIG. 13 is a plan view showing an operation of adjusting a length of the insole shown in FIG. 12.

FIGS. 12 and 13 show another embodiment 20 of means for adjusting a length of the insole 2. As shown in FIGS. 12 and 13, the means 20 for adjusting a length of the insole 2 includes a first insole joint part 21 corresponding to the rear part of the insole 2, a second insole joint part 22 corresponding to the front part of the insole 2, and an adjusting rod 23 for adjusting a spacing between the first and second insole joint parts 21 and 22.

The first insole joint part 21 includes a dovetail groove 21-1 formed at a lower surface of the rear part of the insole 2 and having a certain length, and a first adjusting hole 21-2 extended from a rear end of the dovetail groove 21-1 to a rear end of the insole 2.

The second insole joint part 22 includes a dovetail insert 22-2 having a proper length to be slidably inserted into the dovetail groove 21-1, a second adjusting hole 22-3 forwardly extended from a rear end of the dovetail insert 22-2, an adjusting recess 22-4 formed at a lower surface of the second insole joint part 22 to communicate with a front end of the adjusting hole 22-3, and a nut member 22-5 fitted into the adjusting recess 22-4 and having a threaded recess at its lower surface.

The adjusting rod 23 is inserted into the first adjusting hole 21-2 of the first insole joint part 21 and the second adjusting hole 22-3 of the second insole joint part 22, and is provided at its front region with a threaded portion 23*a* and provided at its rear end with an adjusting recess 23*b*. The adjusting rod 23 is further provided at its front end with a bulging end 23*d*.

Facing ends of the first and second insole joint parts 21 and 22 are provided with inclined surfaces 21*c* and 22*c* corresponding to each other.

Figure 14:
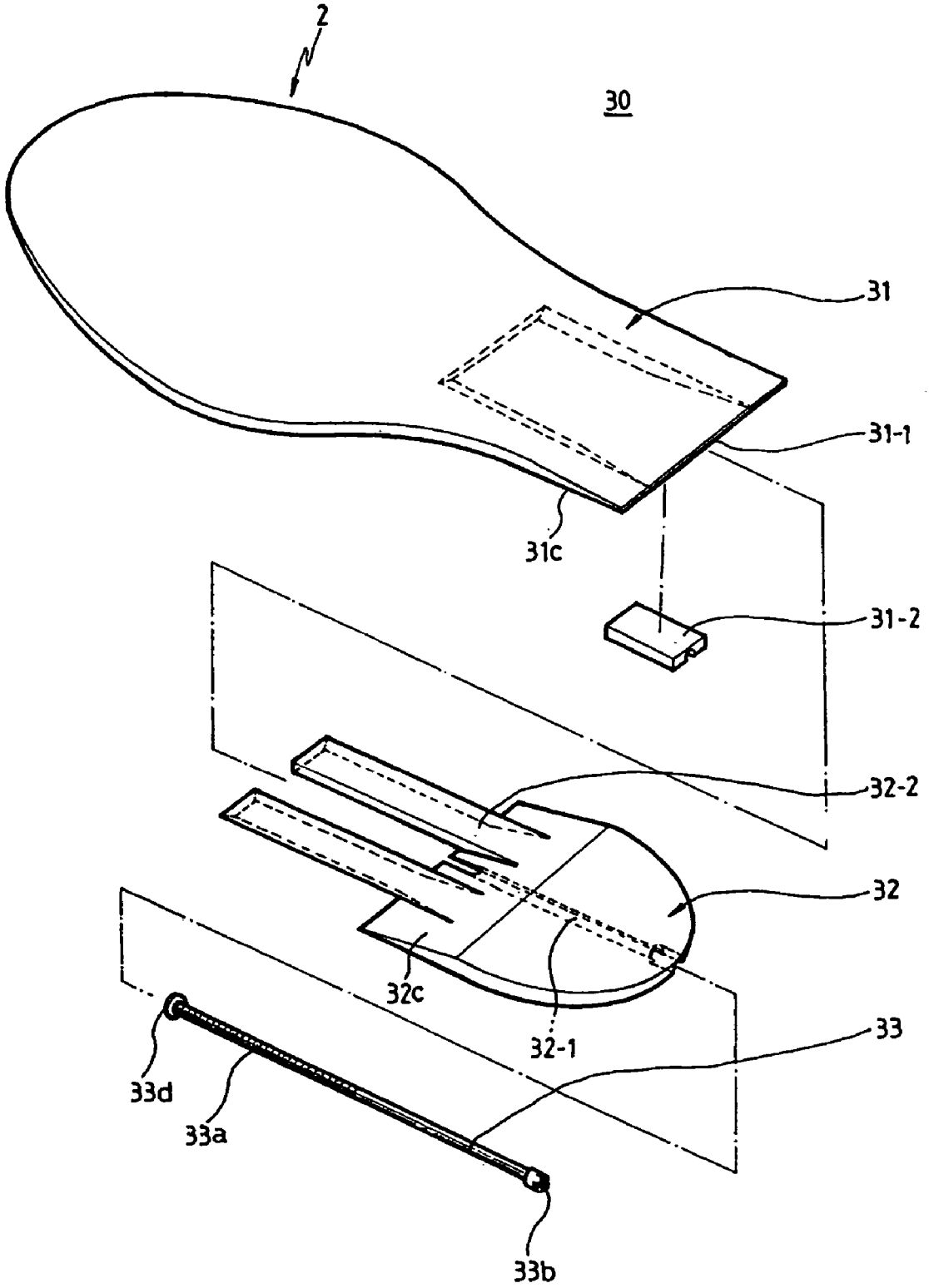
FIG. 14 is an exploded perspective view of still another embodiment of an insole of the shoe according to the present invention.
Figure 15:
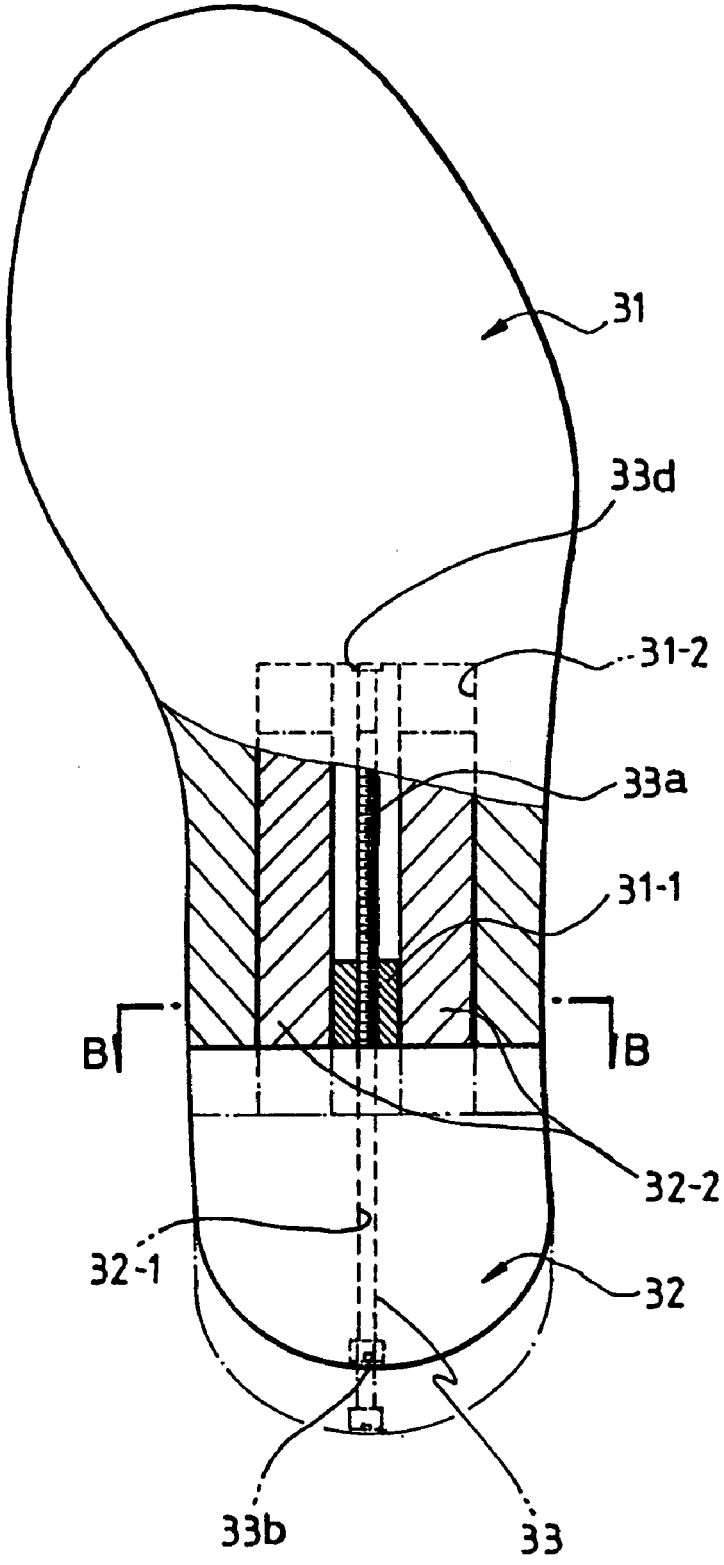
FIG. 15 is a plan view showing an operation of adjusting a length of the insole shown in FIG. 14.
Figure 16:
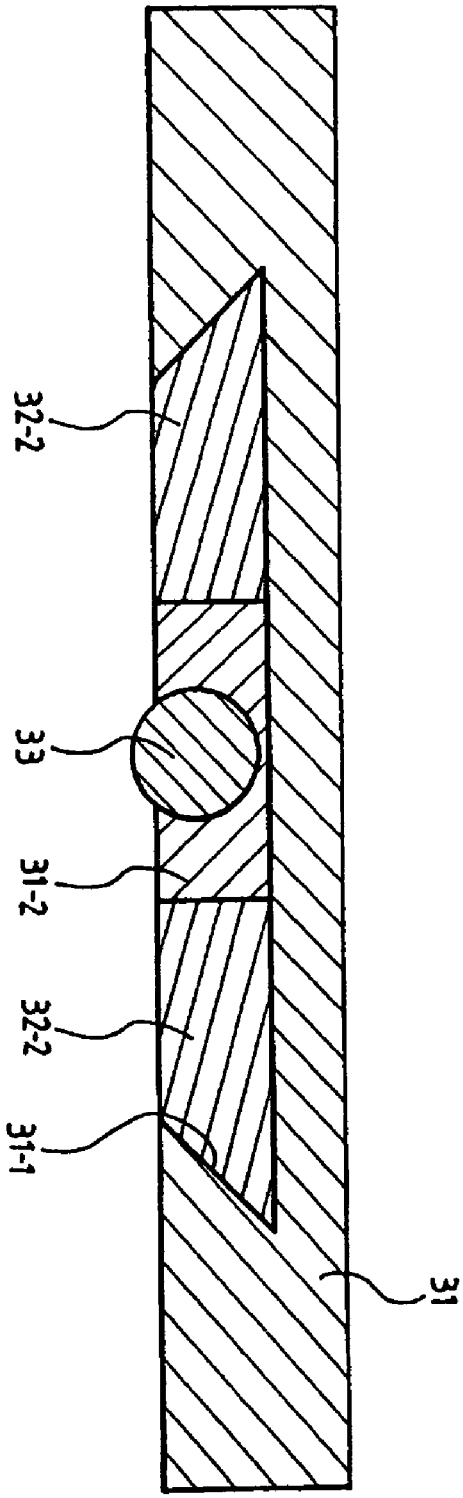
FIG. 16 is a cross-sectional view taken along line B—B of FIG. 15.

FIGS. 14 to 16 show still another embodiment of means for adjusting a length of the insole 2. As shown in FIGS. 14 to 16, the means 30 for adjusting a length of the insole 2 includes a first insole joint part 31 corresponding to the front part of the insole 2, a second insole joint part 32 corresponding to the rear part of the insole 2, and an adjusting rod 33 for adjusting a spacing between the first and second insole joint parts 31 and 32.

The first insole joint part 31 includes a dovetail groove 31-1 formed at a lower surface of the rear part of the insole 2 and having a certain length, and a nut member 31-2 attached to the center of the dovetail groove 31-1 and having a threaded recess at its lower surface.

The second insole joint part 32 includes a pair of dovetail inserts 32-2 having a proper length to be slidably inserted into the dovetail groove 31-1, and an adjusting hole 32-1 forwardly extended from its rear end.

The adjusting rod 33 is inserted into the adjusting hole 32-1 of the second insole joint part 32, and is provided at its front region with a threaded portion 33*a* and provided at its rear end with an adjusting recess 33*b*. The adjusting rod 23 is further provided at its front end with a bulging end 33*d* to be engaged with the threaded portion 33*a* thereof.

The adjusting recess 33*b* of the adjusting rod 33 enables the adjusting rod 33 to be rotated by a tool such as a screwdriver. The rear end of the adjusting rod 33 is embedded in the second insole joint part 32 so as not to be protruded outward.

Facing ends of the first and second insole joint parts 31 and 32 are provided with inclined surfaces 31*c* and 32*c* corresponding to each other.

Since the front ends of the adjusting rods 23 and 33 are provided at their front ends with the bulging ends 23*d* and 33*d*, the adjusting rods 23 and 33 cannot be separated from the insole 2 during adjustment of the rods 23 and 33. Engagement of the nut members 22-5 and 31-2 with the adjusting rods 23 and 33 is fulfilled by forcibly fitting the adjusting rods 23 and 33 into the threaded recesses of the adjusting rods 23 and 33.

As shown in FIG. 1 and FIGS. 6 to 9, the upper tension member 40, which is provided at the upper 3 of the shoe 1, is preferably made of spandex, and the lower tension member 50, which is provided at the outsole 4 of the shoe 1, is made of elastic material to have a bellows shape and a certain thickness. Preferably, the lower tension member 50 is integrally formed with the outsole 4, such that the lower tension member 50 is positioned at a region of the outsole 4 which is spaced from the ground, that is, which does not contact the ground, when a wearer is in a standing position.

Figure 6:
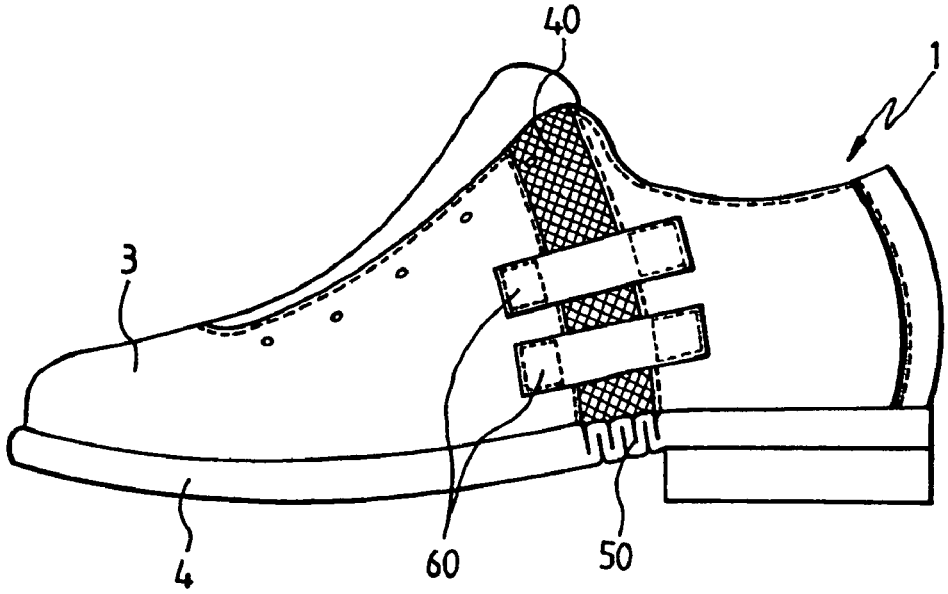
FIG. 6 is a side view of a shoe, an upper of which is provided with a Velcro fastener as a fastening means according to the present invention.
Figure 7:
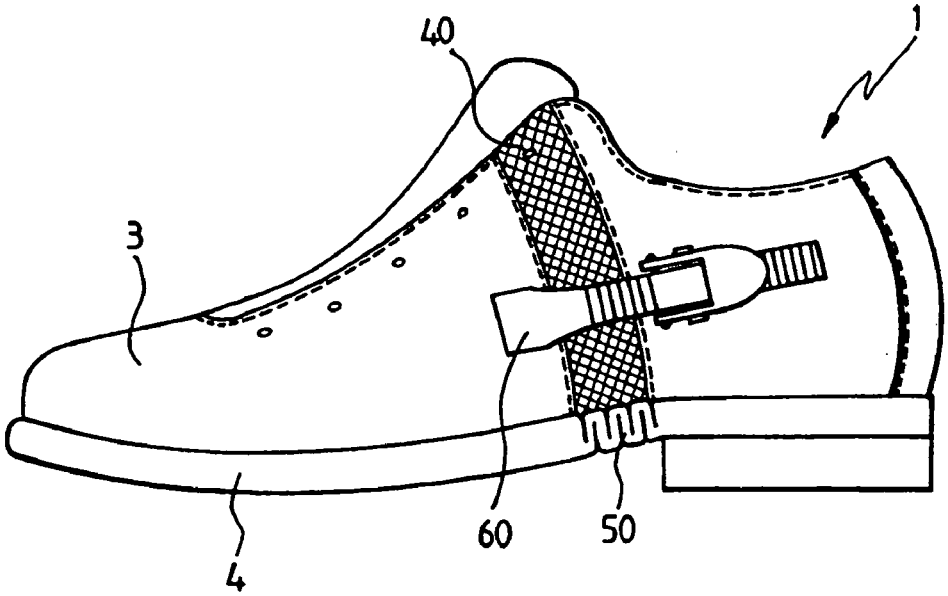
FIG. 7 is a side view of a shoe, an upper of which is provided with a buckle band as a fastening means according to the present invention.
Figure 8:
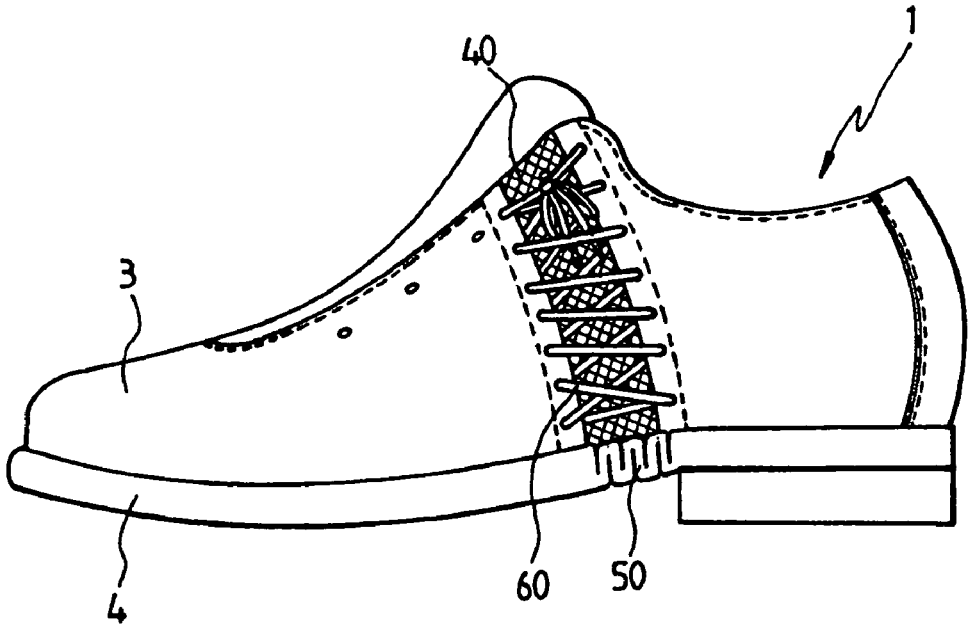
FIG. 8 is a side view of a shoe, an upper of which is provided with a shoelace as a fastening means according to the present invention.

As shown in FIGS. 6 to 8, the fastening means 50, which is provided at the upper 3 of the shoe 1 to be positioned over the upper tension member 40, may be embodied by shoelaces, Velcro fasteners or buckle bands.

In the embodiments of the present invention, the shoe 1 may be applied to, but is not limited to, athletic shoes, mountaineering boots, golf shoes, walking shoes, military boots and work shoes, lengths of which can be adjusted at their insoles 2, uppers 4 and outsoles 4.

Functions and effects of the length-adjustable shoe according to the present invention will now be described in detail.

A wearer buys the shoes 1 having a size suitable to his feet. When there is a need to adjust a length of the shoe because the wearer's feet have grown by a certain amount, a liner (not shown) is first separated from the insole 2 of the shoe 1 to expose the insole 2 to the outside. In this state, a length of the shoe 1 can be adjusted to be suitable to the wearer's foot by manipulating the length-adjusting means 10.

Figure 2:
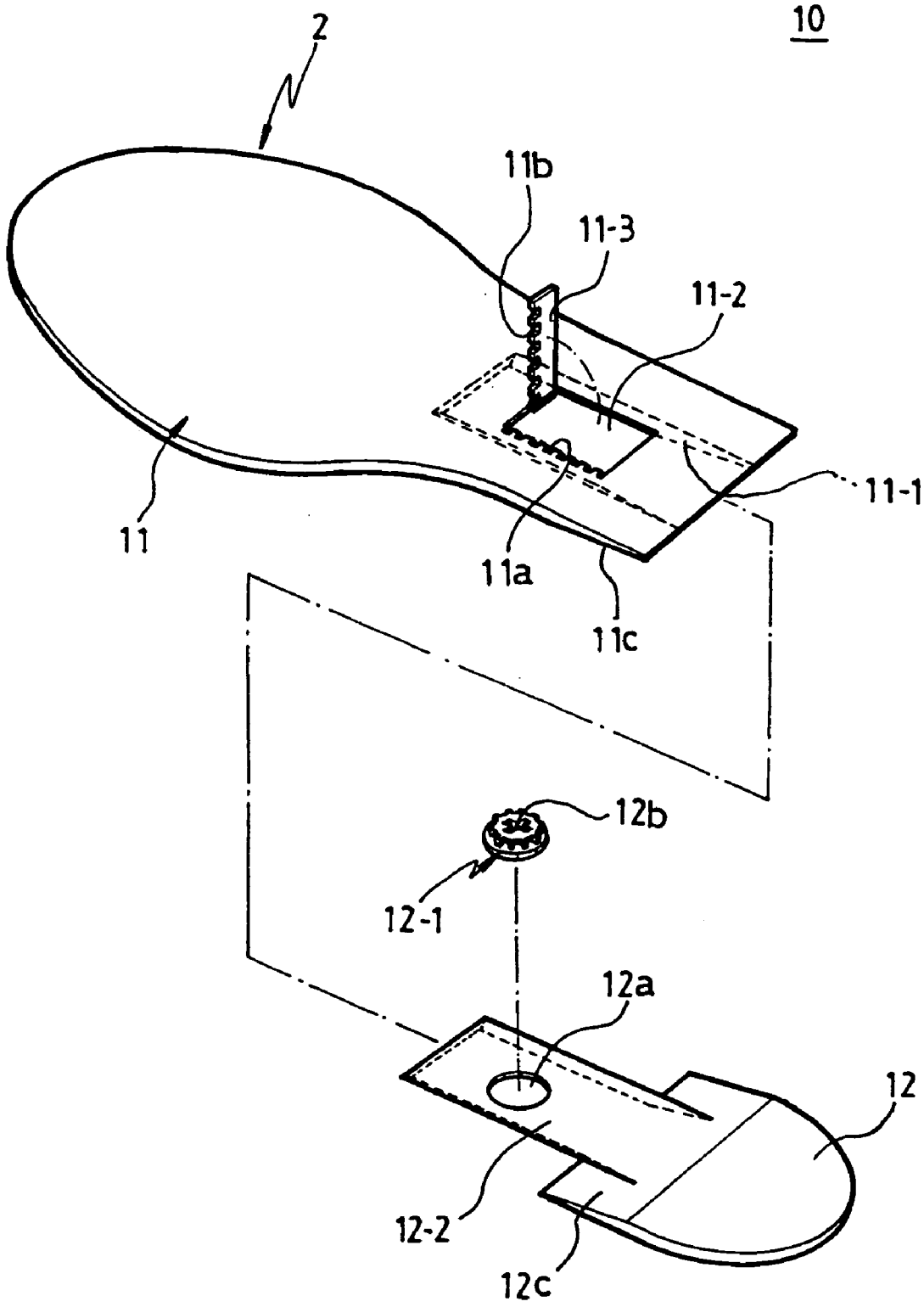
FIG. 2 is an exploded perspective view of an insole of the shoe according to the present invention.
Figure 3:
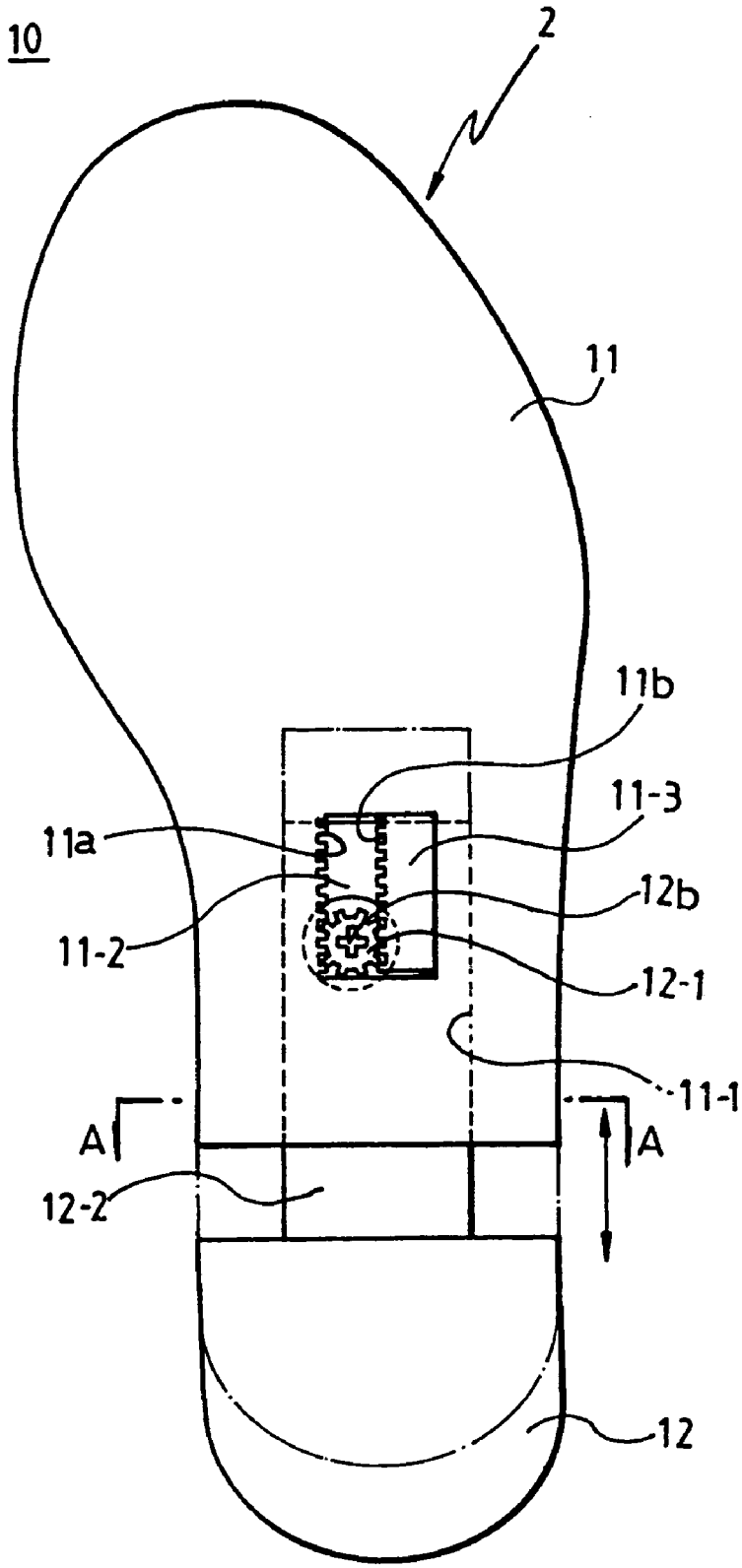
FIG. 3 is a plan view showing an operation of adjusting a length of the insole shown in FIG. 2.

This operation is more specifically described with reference to FIGS. 1 to 3. After the liner is separated from the insole 2 of the shoe 1, the fixing key 11-3 provided in the length-adjusting hole 11-2 of the first insole joint part 11 is raised about its hinged front end to be disengaged from the rack 11*b* of the fixing key 11-3 in such a way that the recess formed at the rear end of the fixing key 11-3 is engaged with a thin tool and then raised by the thin tool.

In this state, the first insole joint part 11 is forwardly moved with respect to the second insole joint part 12 by a desired distance by rotating the spur gear 12-1 engaged with the rack 11*a* provided at one side of the length-adjusting hole 11-2. Therefore, a length of the insole 2 is adjusted to be suitable to a size of a wearer's foot.

At this point, since the spur gear 12-1 is provided at its upper surface with the cross recess 12*b*, as the spur gear 12-1 is rotated by a screwdriver, the rack 11*a*, i.e., the first insole joint part 11, is moved forward. Consequently, the inclined surface 11*c* of the first insole joint part 11 is spaced from the inclined surface 12*c* of the second insole joint part 12.

The maximum spacing between the first and second insole joint parts 11 and 12 is set to be about 10 mm, so as not to allow the spacing to exceed the deformation limit for a given size of the shoe 1.

Since the spur gear 12-1 is snugly fitted in the seat recess 12*a* formed at the upper surface of the dovetail insert 12-2 of the second insole joint part 12 by a certain depth, the spur gear 12-1 is stably rotated in the seat recess 12*a*. As the spur gear 12-1 is rotated, the dovetail insert 12-2 of the second insole joint part 12 is slidably moved with respect to the dovetail groove 11-1 until a total length of the first and second insole joint parts 11 and 12 reaches a desired length.

Figure 4:
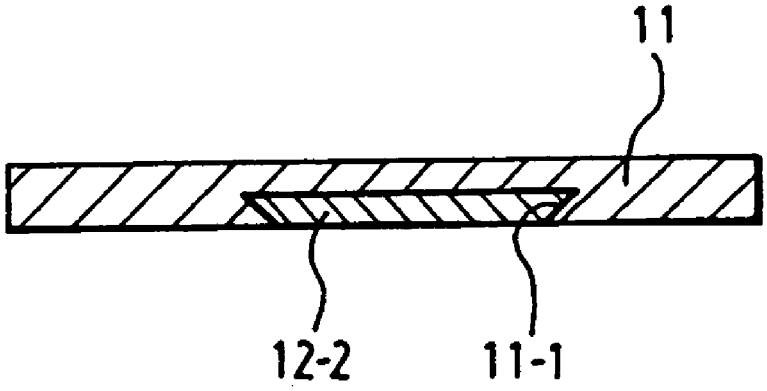
FIG. 4 is a cross-sectional view taken along line A—A of FIG. 3; which shows a coupling state of a dovetail groove and a dovetail insert according to the present invention.
Figure 5:
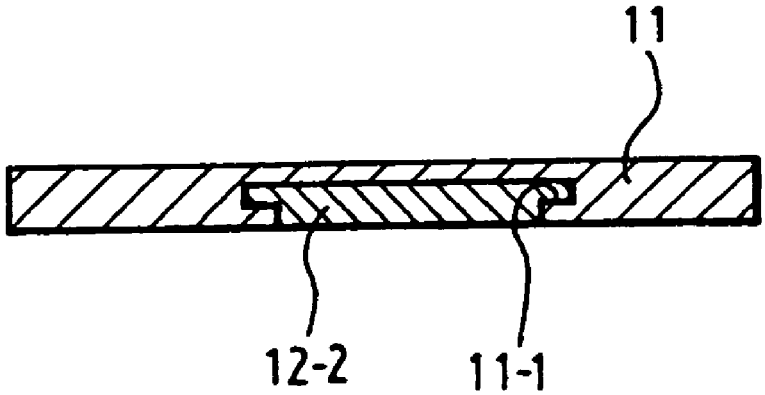
FIG. 5 is a cross-sectional view taken along line A—A of FIG. 3, which shows a coupling state of a dovetail groove and a dovetail insert according to another embodiment of the present invention.

As appreciated from FIGS. 4 and 5, the dovetail groove 11-1 and the dovetail insert 12-2 function to prevent separation or bending of the insole 2 at the separated region of the insole 2 even though the inclined surfaces 11*c* and 12*c* of the dovetail groove 11-1 and the dovetail insert 12-2 are separated from each other after the adjustment of the length of the insole 2 is completed.

After the above-mentioned adjustment of the length of the insole 2, the fixing key 11-3 is fitted into the length-adjusting hole 11-2 again. At this point, since the spur gear 12-1 is engaged with the rack 11*a* of the length-adjusting hole 11-2 at its one side, and engaged with the rack 11*b* of the fixing key 11-3 at the opposite side, the spur gear 12-1 is firmly held not to be rotated. Thereafter, the liner is again placed on the insole 2.

Even though the first insole joint part 11 is spaced from the second insole joint part 12 and then fixed thereto, the first and second insole joint parts 11 and 12 are in contact with each other at their inclined surfaces 11*c* and 12*c*, as shown in FIG. 1. Therefore, a wearer hardly feels the spaced condition of the insole 2, and interference between the upper surface of the insole 2 and a sole of his foot is considerably reduced.

A distance between the adjacent teeth of the spur gear 12-1, and the racks 11*a* and 11*b* is preferably set such that a total length of the first insole joint part 11 and the second insole joint part 12 is increased in increments of any distance between 1 mm to 1.3 mm at a time, thereby allowing a total length of the insole 2 to be finely adjusted.

To accommodate the increased length of the insole 2 after the adjustment of a length of the insole 2, the upper 3 of the shoe 1 is provided with the upper tension member 40, and the outsole 4 of the sole 1 is provided with the lower tension member 50. Consequently, after the adjustment of a length of the insole 2, the upper and lower tension members 40 and 50 extend by the increased length of the insole 2, thereby providing a comfortable wearing condition to a wearer.

Since the lower bellows-shaped tension member 50 provided at the outsole 4 is positioned at a region which is spaced from the ground, that is, which does not contact the ground, the lower tension member 50 is protected from interfering with the ground during walking.

Since the upper tension member 40 provided at the upper 4 of the shoe 1 is made of elastic rubber material which is extended and restored by application and release of external force, the shoe 1 can accommodate a pressure applied thereto during walking. Furthermore, the shoe 1 can accommodate wearer's feet having any size within an allowable range by only the upper and lower tension members 40 and 50 without manipulating other means for adjusting a length of the insole 2.

As shown in FIGS. 6 to 8, the means 60 for fastening the upper 3 of the shoe 1 is intended to assure a stable wearing condition after the adjustment of a length of the insole 2. The fastening means 60 may be embodied by shoelaces, Velcro fasteners or buckle bands according to a desired design of the shoe 1.

Figure 10:
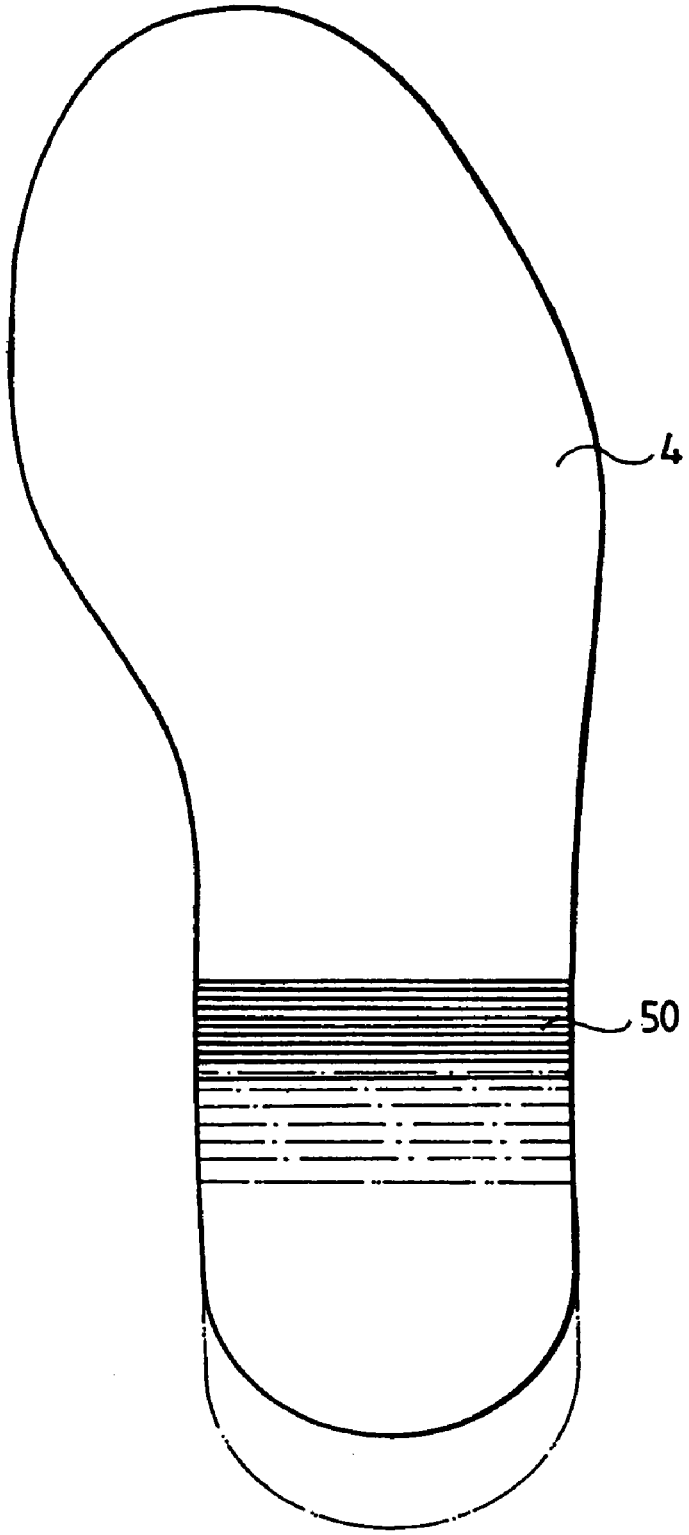
FIG. 10 is a plan view of an outsole, which is provided at its front portion with a tension member according to the present invention.
Figure 11:
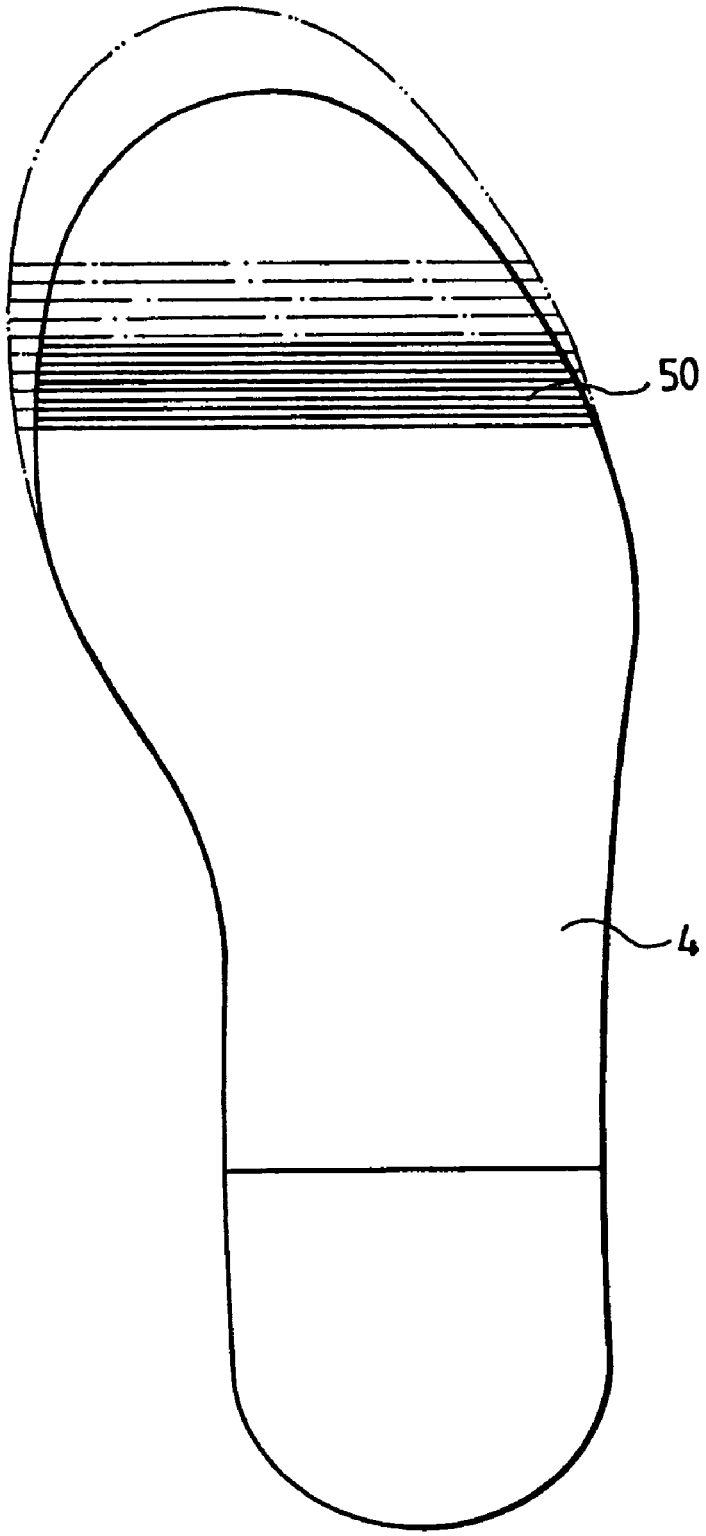
FIG. 11 is a plan view of an outsole, which is provided at its rear portion with a tension member according to the present invention.

FIGS. 10 and 11 show the lower bellows-shaped tension members 50 according to the present invention, which are deformed according to external pressure. In the drawings, FIG. 10 shows the lower tension member 50 positioned at a rear region of the outsole 4, and FIG. 11 shows the lower tension member 50 positioned at a front region of the outsole 4. As appreciated from the drawings, the lower tension member 50 enables the shoe 1 to accommodate a wearer's rotated by a screwdriver in a direction of loosening the adjusting rod 23, the threaded portion 23*a* of the adjusting rod 23, which is inserted in the first adjusting hole 21-2 of the first insole joint part 21 and the second adjusting hole 22-3 of the second insole joint part 22, is disengaged from the nut member 22-5, thereby causing the second insole joint part 21 to be spaced from the first insole joint part 22.

At this point, the pair of dovetail inserts 22-2 of the second insole joint part 22 is moved forward together with the nut member 22-5 while being guided along the dovetail groove 21-1 of the second insole joint part 21.

The shoe 1 according to this embodiment can accommodate a wearer having a foot with a relatively thick and wide toe portion. Therefore, the shoe 1 can provide a comfortable wearing condition to a wearer suffering hallux valgus or hallux varus.

In still another embodiment 30 of means for adjusting a length of the insole 2 shown in FIGS. 14 to 16, an operation of adjusting a total length of the first and second insole joint parts 31 and 32 is performed as follows.

First, as the adjusting recess 33*b* of the adjusting rod 33, which is positioned at a heel portion and exposed to the outside, is rotated by a screwdriver in a direction of loosening the adjusting rod 33, the threaded portion 33*a* of the adjusting rod 33, which is inserted in the first adjusting hole 32-1 of the first insole joint part 32, is disengaged from the nut member 31-2 attached to the dovetail groove 31-1 of the first insole joint part 31, thereby causing the first insole joint part 31 to be spaced from the second insole joint part 32.

At this point, the dovetail inserts 32-2 of the second insole joint part 32 are moved rearward while being guided along the dovetail groove 31-1 of the first insole joint part 31.

After the adjustment of a length of the insole 2, a wearer puts the shoe 1 on his foot. Thereafter, the wearer can properly fit the shoe 1 to his foot by manipulating the fastening means 60 shown in FIGS. 6 to 8. Since the adjusting rod 33 is positioned at a rear portion of the shoe 1 and thus the adjusting rod is applied to the heel portion of the shoe as weight, a wearer can walk more stably.

Figure 9:
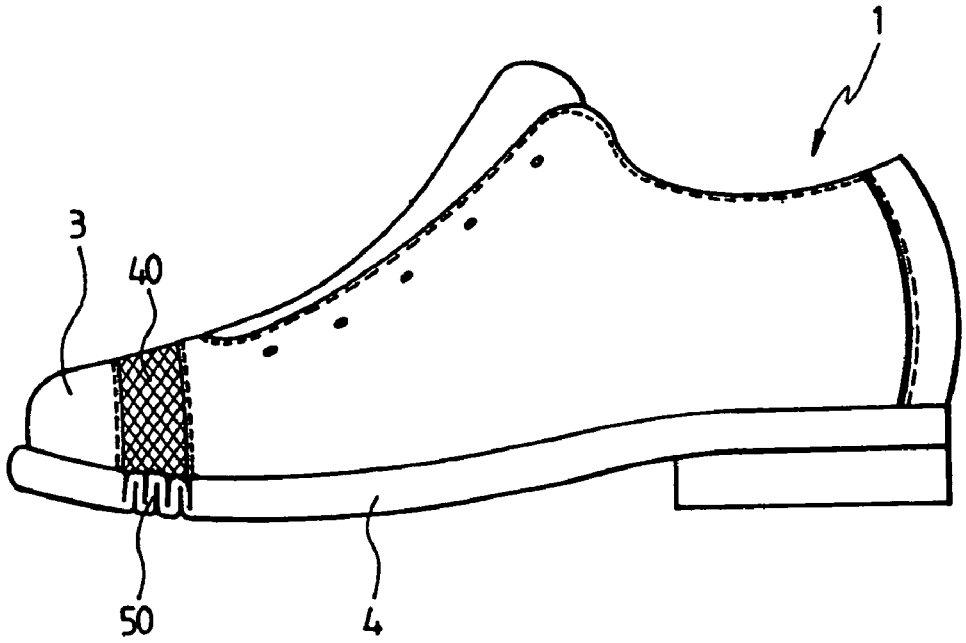
FIG. 9 is a side view of a shoe, which is provided at its toe portion with a tension member according to the present invention.

FIG. 9 shows a shoe 1 in which the upper and lower tension members 4 and 5 are applied to a toe or an instep portion thereof. Accordingly, the shoe 1 shown in FIG. 9 is suitable for a wearer with a wide and thick toe or instep because the front portion of the shoe 1 can be extended forward by a manipulation of the adjusting rod 33 and can be extended outward by the upper and lower tension members 40 and 50.

Since the shoe 1 according to the present invention can be extended and contracted within a range of 10 mm by the length-adjusting means 10, 20 and 30, the upper and lower tension members 40 and 50, and the fastening means 60, the shoe 1 can be comfortably worn by children and youngsters with rapid growth rates and wearers with both feet having different sizes.

As described above, the present invention provides a shoe capable of being extended and contracted longitudinally without change of an outer shape of the shoe, by the length-adjusting means provided at its insole, the upper tension member provided at its upper, the lower tension member provided at its outsole, and the fastening means provided at its upper. Accordingly, the shoe can be worn by a wearer for a long period of time without needless expenditure due to purchase of two pair of shoes.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A length-adjustable shoe, comprising:

an outsole;

an insole attached on the outsole;

an upper attached on the insole and covering a wearer's instep;

means for adjusting a length of the insole to be suitable to a wearer's foot, which is provided at the insole;

an upper tension member provided at the upper to provide tightening force to the upper;

a lower tension member provided at the outsole to provide tightening force to the outsole; and means for fastening a front part and a rear part of the upper divided by the upper tension member, which is provided at the front and rear parts of the upper to maintain a size of the shoe at a wearer's foot size;

wherein the means for adjusting a length of the insole comprises:

a first insole joint part corresponding to a front part of the insole, including:

a dovetail groove formed at a lower surface of the front part of the insole and having a certain length;

a rectangular length-adjusting hole formed at the front part of the insole to be positioned in the dovetail groove, and having a longitudinal rack at its one side; and a fixing key hingedly connected to one side of the length-adjusting hole and having a fixing rack at its one side; and a second insole joint part corresponding to a rear part of the insole, including:

a spur gear having a proper diameter, which is engaged with the fixing rack of the length-adjusting hole and the fixing rack of the fixing key and is provided at its upper surface with a cross recess; and a dovetail insert having a proper length to be slidably inserted into the dovetail groove and having a gear recess at its upper surface to receive a lower portion of the spur gear.

2. A length-adjustable shoe, comprising:

an outsole;

an upper attached on the insole and covering a wearer's instep;

means for adjusting a length of the insole to be suitable to a wearer's foot, which is provided at the insole;

an upper tension member provided at the upper to provide tightening force to the upper;

a lower tension member provided at the outsole to provide tightening force to the outsole; and means for fastening front part and a rear part of the upper divided by the upper tension member, which is provided at the front and rear parts of the upper to maintain a size of the shoe at a wearer's foot size;

wherein the means for adjusting a length of the insole comprises:

a first insole joint part corresponding to a front part of the insole, including:

a dovetail groove formed at a lower surface of the front part of the insole and having a certain length;

a rectangular length-adjusting hole formed at the front part of the insole to be positioned in the dovetail groove, and having a longitudinal rack at its one side; and a fixing key hingedly connected to one side of the length-adjusting hole and having fixing rack at its one side; and a second insole joint part corresponding to a rear part of the insole, including:

a spur gear having proper diameter, which is engaged with the fixing rack of the length-adjusting hole and the fixing rack of the fixing key and is provided at its upper surface with a cross recess; and a dovetail insert having a proper length to be slidably inserted into the dovetail groove and having a gear recess at its upper surface to receive a lower portion of the spur gear;

wherein facing ends of the first and second insole joint parts are provided with inclined surfaces corresponding to each other.

* * * * *